United States Patent [19]

Gilchrist et al.

[11] 3,979,872

[45] Sept. 14, 1976

[54] YIELDABLE DOOR BODY

[75] Inventors: Henry R. Gilchrist, Burlington; Hollis M. Berry, Lakeville, both of Mass.

[73] Assignee: Eckel Industries, Inc., Cambridge, Mass.

[22] Filed: Mar. 2, 1972

[21] Appl. No.: 231,205

[52] U.S. Cl. ..... 52/624; 160/354; 49/501

[51] Int. Cl.[2] ..... E04C 2/00; E06B 3/00

[58] Field of Search ..... 49/501, 502, 48 B, 50; 52/624, 625, 615; 160/354

[56] References Cited

UNITED STATES PATENTS

| | | | |
|---|---|---|---|
| 2,619,167 | 11/1952 | Eckel | 160/354 |
| 2,815,808 | 12/1957 | Eckel | 160/354 |
| 3,146,826 | 9/1964 | Eckel | 160/354 |
| 3,520,084 | 7/1970 | Gigante | 49/501 |
| 3,521,528 | 7/1970 | Wangerow | 404/69 |
| 3,579,724 | 5/1971 | Toth | 52/403 |

*Primary Examiner*—Ernest R. Purser
*Assistant Examiner*—James L. Ridgill, Jr.
*Attorney, Agent, or Firm*—Schiller & Pandiscio

[57] ABSTRACT

A door body formed largely of yieldable material has two panels spaced apart with a hollow separator between them that is rectangular in cross section and has two pairs of oppositely disposed sides and two dividers therein at right angles to each other that thereby provide four enclosed openings. This construction holds the paneled portion of the door body firm, especially at the outer edges, yet is flexible enough to permit some distortion when the door is forcibly opened as by striking it vigorously with a moving truck.

7 Claims, 6 Drawing Figures

YIELDABLE DOOR BODY

The principal object of my invention is to provide a door body with a novel separator therein that can be economically produced and assembled with a door, that will maintain the door body moderately rigid, yet be sufficiently resilient to avoid damaging the body or straining the supports that connect it to the door jamb, when forcibly opened.

The foregoing and other objects which will appear as the nature of the invention is better understood, may be accomplished by a construction, combination and arrangement of parts such as is disclosed by the drawings. The nature of the invention is such as to render it susceptible to various changes and modifications, and therefore, I am not to be limited to the construction disclosed by the drawings nor to the particular parts described in the specification; but am entitled to all such changes therefrom as fall within the scope of my invention.

Figure 1:
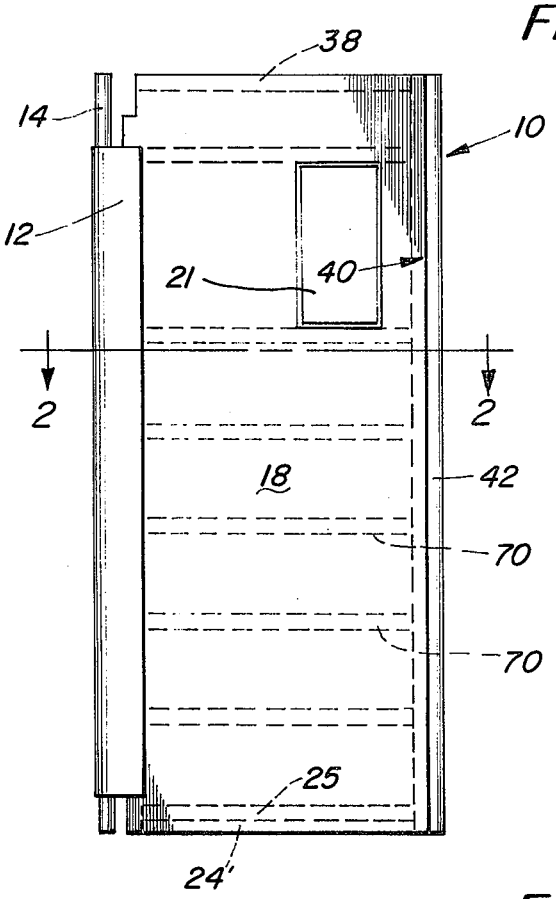
FIG. 1 is a front elevational view of a single door.

As illustrated, a single door 10 has a jamb guard 12 and a mounting post 14 extending therethrough, and inwardly thereof is a wood filler 16. A door body has a front panel 18 that is spaced from a rear panel 10 both of which are of rubber or other resilient material; and both extend inwardly to said post 14, terminating between said guard 12 and said filler 16 as shown. A transparent member 21 is attached to said panel 18, serving as a window.

Figure 4:
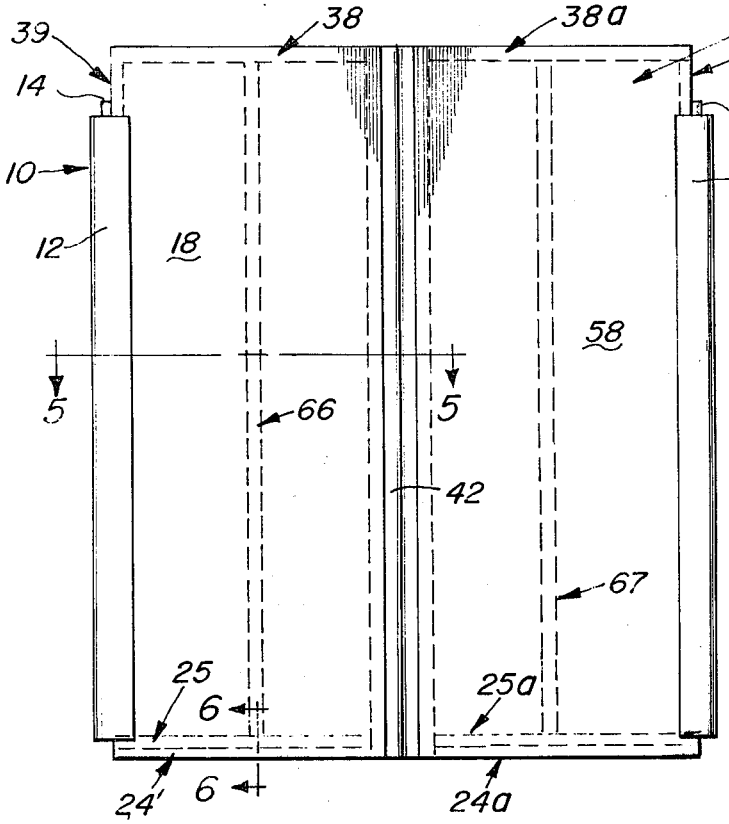
FIG. 4 is a front elevational view of a double door.
Figure 5:
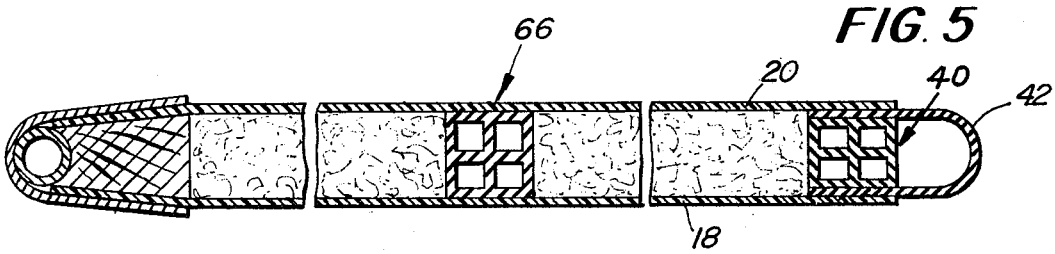
FIG. 5 is an enlarged sectional view taken on the line 5—5 of FIG. 4.
Figure 6:
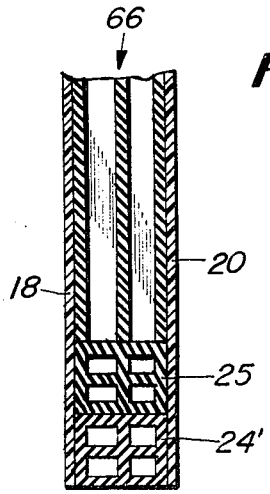
FIG. 6 is an enlarged sectional view taken on the line 6—6 of FIG. 4, showing separators in horizontal position and in vertical position.

Between said front and rear panels I preferably provide a filler 22, such as fiberglass, and also a separator which I show, as at 24, in detail in said FIG. 4. The latter is cemented, or otherwise attached to the faces of said panels. This separator is constructed with four sides 26, 28, 30 and 32 to provide a rectangularly-shaped member, preferably oblong in cross-section. A divider 34 extends between said sides 30 and 32 and another divider 36 at a right angle to divider 34 extends between said sides 26 and 28. This construction provides four openings or interior spaces in each separator, so that it will yield or distort when forcibly struck, as by a moving truck, in opening the door. Said dividers 34 and 36 provide firmness to the hollow separator, particularly at the outer edges of the door body where the door body is especially vulnerable.

As illustrated in FIG. 1 a bottom said separator is given the numeral 24' while another adjoining it above is given numeral 25. At the outer edge of said body a vertically extending said separator is given numeral 40, and an upper said separator 38.

Figure 2:
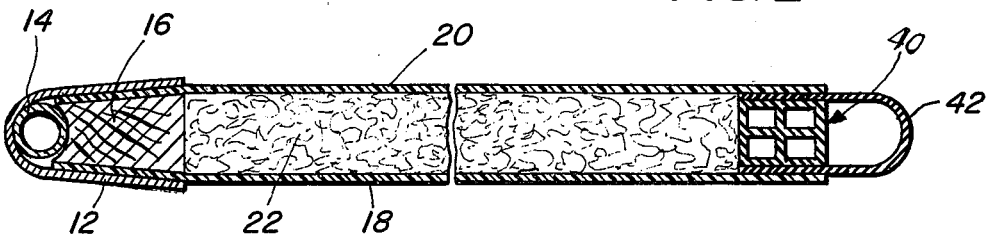
FIG. 2 is an enlarged sectional view taken on the line 2—2 of FIG. 1.

I preferably provide a well-known tubular-shaped nose member 42 at the outer edge of the door, inner portions of which are retained between said panels 18 and 20 and said separator sides 26 and 28, as shown in said FIG. 2.

To give a door additional rigidity I may provide additional said separators, such as an upper said separator 38, crosswise of the door and which are shown attached to said panels 18 and 20 and given numeral 70.

Figure 3:
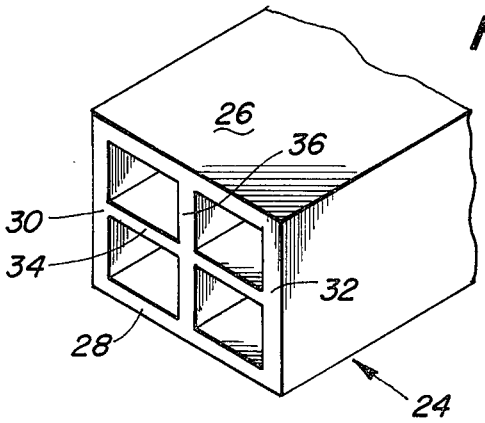
FIG. 3 is a perspective view of a separator for said door greatly enlarged.

In said FIG. 4 I illustrate a double door arrangement, the second door 50 having the usual jamb guard 52 and mounting post 54. There are front and rear panels, only the front one 58 being shown. In each door I show vertically extending said separators 66 and 67 respectively which are located intermediate opposite sides of each door. They extend between two bottom separators **24*a*, 25*a* and a top separator 38*a* of the right hand door, and between said bottom separators 24', 25 and top separator 38 of the left hand door. These separators in each instance, are of the same structure as that shown in said FIG. 3,** being formed of resilient material such as rubber and preferably being integral.

What I claim is:

1. A door body comprising yieldable front and rear panels spaced apart, and a yieldable separator between said panels having two pairs of oppositely disposed sides spaced apart defining a closed rectangle, and having two dividers extending between and spaced respectively from said two pairs of said sides to thereby define four openings in said separator.

2. A door body as of claim 1, said separator extending adjacent an edge of said body.

3. A door body as of claim 1, and another said separator extending horizontally between said two panels adjacent another edge of said body.

4. A door body as of claim 1, and another said separator extending intermediate opposite sides of said body.

5. A door body as of claim 1, said separator extending vertically adjacent an outer edge of said body, and a plurality of other said separators one of which extends adjacent the bottom extremity of said body and another of which plurality extends adjacent the upper extremity of said door.

6. A door body as of claim 1, said separator extending vertically adjacent an outer edge of said body, and a tubular-shaped nose at the outer extremity of said body and having two portions extending laterally inward between said panels, said separator extending between said opposite nose portions and directly inward of said panels.

7. A door body as of claim 1 and another said separator, a first of said separators extending horizontally of said body and a second of said separators extending from and in contact with said first separator vertically of said body.

* * * * *